US005692893A

United States Patent [19]

Houston

[11] Patent Number: 5,692,893

[45] Date of Patent: Dec. 2, 1997

[54] ROTARY VALVE FOR 2-BED REGENERATIVE FUME INCINERATOR

[76] Inventor: Reagan Houston, 252 Foxhunt La., Hendersonville, N.C. 28791

[21] Appl. No.: 698,968

[22] Filed: Aug. 16, 1996

[51] Int. Cl.[6] ..... F27D 17/00

[52] U.S. Cl. ..... 432/181; 432/180; 137/309

[58] Field of Search ..... 432/179, 180, 432/181; 137/311

[56] References Cited

U.S. PATENT DOCUMENTS

| | | | |
|---|---|---|---|
| 3,796,232 | 3/1974 | Dalton | 137/625.21 |
| 3,870,474 | 3/1975 | Houston | 23/277 |
| 4,522,588 | 6/1985 | Todd et al. | 432/181 |
| 4,741,690 | 5/1988 | Heed . | |
| 5,129,332 | 7/1992 | Greco | 432/181 |
| 5,134,945 | 8/1992 | Reimlinger et al. | 432/180 |
| 5,184,951 | 2/1993 | Nutcher et al. . | |
| 5,431,147 | 7/1995 | Tanaka et al. | 432/181 |
| 5,578,276 | 11/1996 | Klobucar | 432/181 |

*Primary Examiner*—Henry A. Bennett
*Assistant Examiner*—Gregory A. Wilson
*Attorney, Agent, or Firm*—Charles L. Schwab

[57] ABSTRACT

A rotary valve suitable for a 2-bed regenerative fume incinerator which provides for purging of the beds and uninterrupted inflow and outflow during operation of the incinerator including the time intervals in which the valve is rotated from one position of operation to another and during the time intervals in which the beds are individually purged.

15 Claims, 10 Drawing Sheets

ROTARY VALVE FOR 2-BED REGENERATIVE FUME INCINERATOR

TECHNICAL FIELD

This invention relates to a rotary valve for regenerative fume incinerators (also called regenerative thermal oxidizers) having two regenerative beds and particularly to a rotary valve providing continuous flow of gas into and out of incinerator and operable to purge the regenerative beds.

INFORMATION DISCLOSURE STATEMENT

In present practice, 2-bed fume incinerators use four 2-way valves to control the flow of impure feed gas to the beds and purified exit gas from the beds. Two additional valves are customarily used to isolate and reprocess the surge of impure gas which occurs when the flows are reversed or to direct the feed to the combustion chamber for a short interval while a regenerator is being purged. Examples of reprocessing the surge gas are disclosed in U.S. Pat. No. 3,870,474 by Houston and U.S. Pat. No. 4,741,690 by Heed. One example of momentarily sending the feed gas to the combustion chamber is given by U.S. Pat. No. 5,184,951 by Nutcher and Waldern. Incinerators treat very large quantities of contaminated gas and the conduits range in size up to 60 inches in diameter and larger. Obviously the required valves are large, must be power operated and are very expensive. My co-pending U.S. patent application "Continuous Flow Rotary Valve for Regenerative Fume Incinerators", Ser. No. 08/662,003, describes a valve suitable for 3 and 5 bed incinerators.

OBJECTS AND SUMMARY OF THE INVENTION

It is a primary object of this invention to provide a rotary valve suitable for use in a 2-bed regenerative fume incinerator which does not interrupt the flow to and from the refractory filled beds during repositioning of the valve rotor. It is a further object of this invention to provide a rotary valve for controlling the flow through two regenerative beds of a fume incinerator while maintaining the flow nearly constant while the rotor is being repositioned to alternate the flow through the beds. It is a further object to provide a rotary valve for a 2-bed regenerative fume incinerator which at all times substantially eliminates leakage of impure gas into purified gas. It is a further object to provide a valve which controls the gas flows to purge each bed of impure gas before it is used to handle purified gas.

The single rotary valve of this invention replaces the four or six 2-way valves heretofore used in 2-bed regenerative fume incinerators. The gas flows are not interrupted at any time, including the time interval when the rotor is being repositioned. The choice of design parameters allows the flow rate during the purge interval to equal the flow rate during the main interval. Thus pressure and flow surges are essentially eliminated.

BRIEF DESCRIPTION OF THE DRAWINGS

Several embodiments of the invention are shown in the drawings, in which.

DETAILED DESCRIPTION OF THE DRAWINGS

Figure 1:
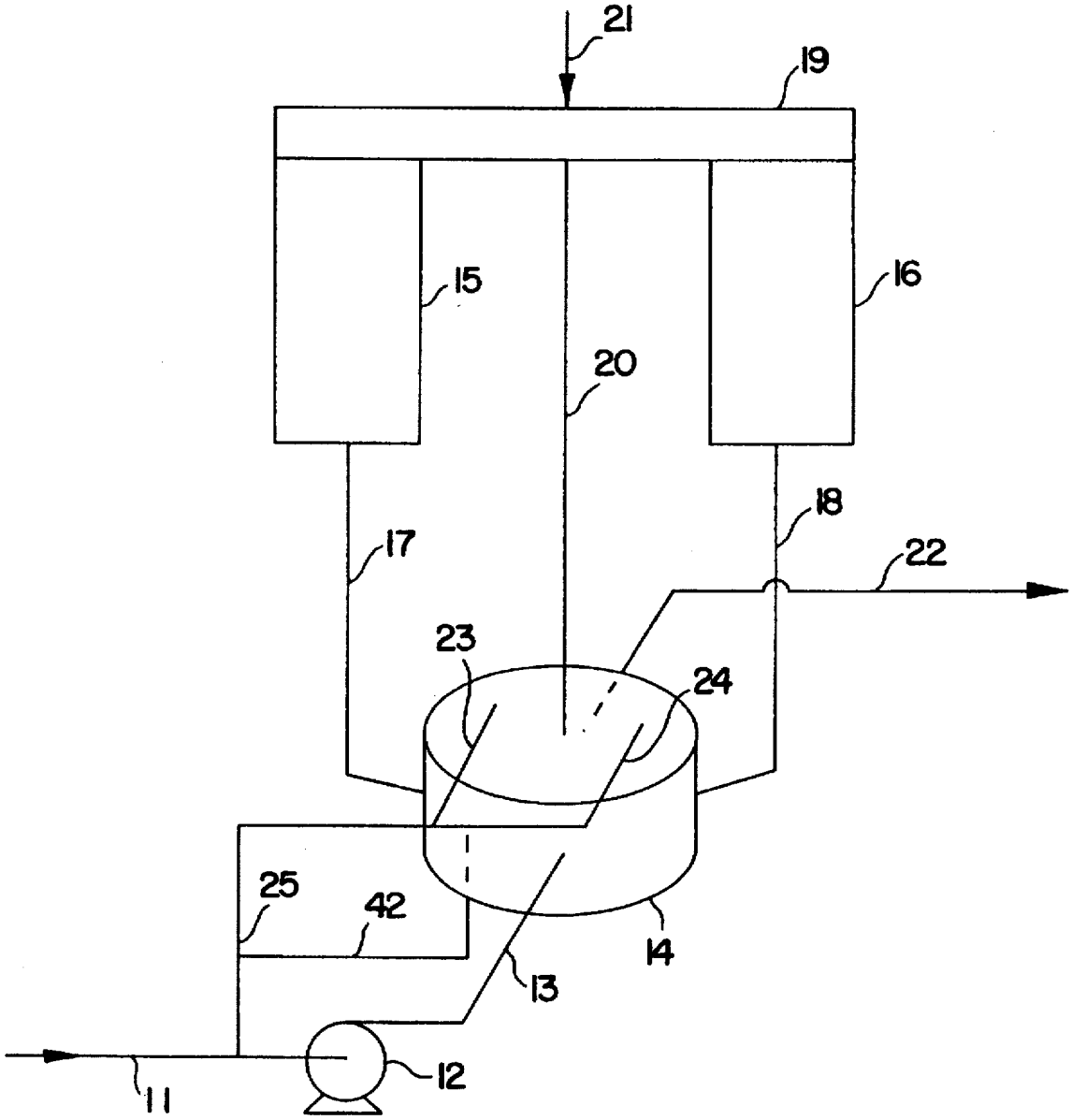
FIG. 1 is a flow diagram of a 2-bed regenerative fume incinerator system.

Referring to FIG. 1, the incoming, contaminated feed gas flows through a feed line 11 into a blower 12, through an input line 13 to a rotary valve 14 which directs the feed gas to either of two refractory filled regenerative beds 15, 16 by way of bed lines 17, 18 or to combustion chamber 19 through bypass line 20. From the selected bed 15 or 16, the feed gas flows into a combustion chamber 19 where volatile organic compounds are oxidized to $CO_2$ and $H_2O$. Fuel may be supplied to the combustion chamber 19 by a fuel line 21. The combustion chamber 19 is typically maintained at 1300 to 1800 degrees. F.; although it is known to use a catalyst as pan of the bed packing to lower this temperature. Purified or cleaned gas goes to the other bed 16 or 15 and into the rotary valve 14 through bed line 18 or bed line 17. Purified gas leaves the rotary valve 14 by an exit line 22 and may be exhausted to the atmosphere. Heat from the purified gas is absorbed by the refractory in one bed for an interval while the incoming unclean gas is being heated by the other bed. The rotary valve 14 is repositioned at regular intervals to alternate the flow through the beds 15 and 16 so that the beds 15 and 16 are alternately heated and cooled while the feed gas is heated and the cleaned gas is cooled.

A main purge line 25 is connected at one of its ends to the feed line 11 on the input side of the blower 12. A pair of branch purge lines 23 and 24 are connected to the other end of the main purge line 25 and to the rotary valve 14 so that beds 15, 16 can be cyclically purged of contaminated gas by clean gas flowing from the combustion chamber 19, through bed 15 or bed 16, line 17 or line 18, rotary valve 14, line 23 or line 24, line 25 and into the suction of the blower 12 by way of the line 11. For instance, the bed 16 can be purged of impure gas by the flow of purified gas from the combustion chamber 19, through the bed 16, the line 18, the rotary valve 14, the purge line 24, the line 25 and into the suction of blower 12 by way of the line 11. The purge flow through the purge lines 23, 24 is a minor fraction of the exit gas flow and the purge gas flows only during the purge interval. The purge interval is a small fraction of the regular interval. A minor purge line 42 interconnects the main purge line 25 to a minor purge inlet opening 45, shown in FIG. 5, in the lower end of the valve body 30. The pressure in feed line 11 at the blower 12 inlet is normally less than the pressure of the exit gas in the exit line 22. Where this is not the case, an auxiliary blower, not shown, is required in purge line 25 to pull purge gas from the rotary valve 14. Purging may also be accomplished with clean air via purge line 25 at a pressure greater than the pressure in the exit line.

Figure 2:
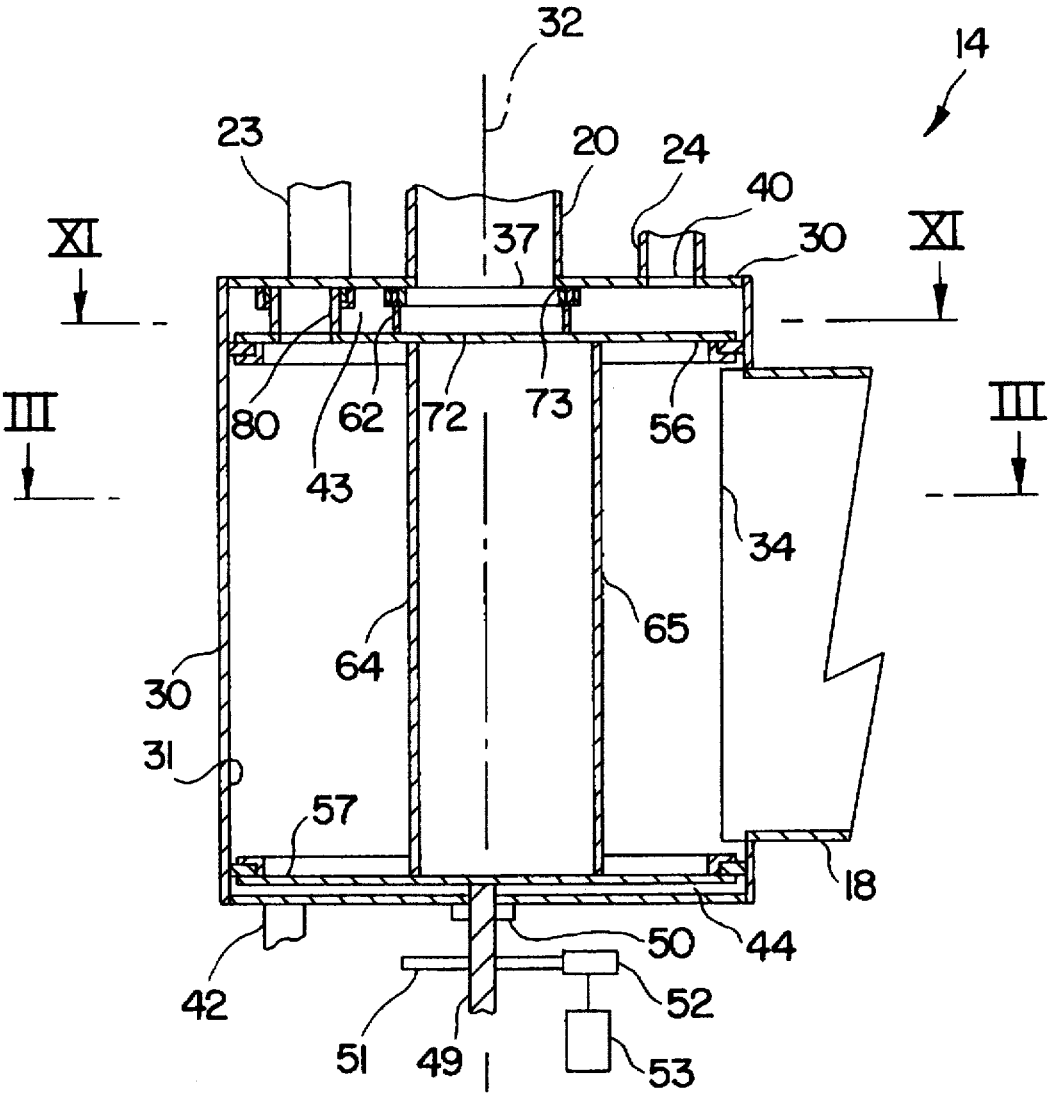
FIG. 2 is a vertical section of the rotary valve taken along line II—II in FIG. 3.
Figure 3:
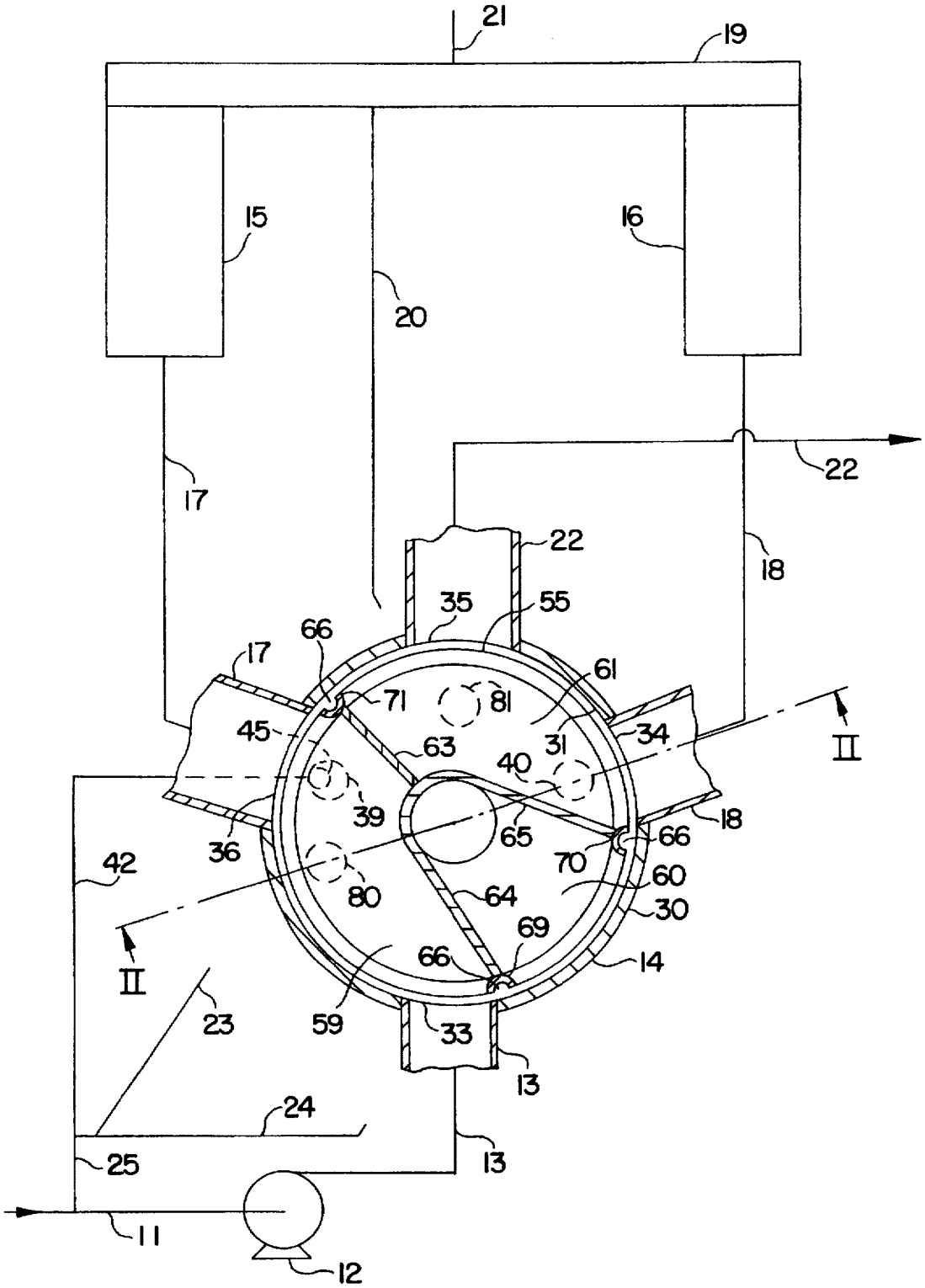
FIG. 3 is a horizontal section taken along line III—III in FIG. 2.

As shown in FIGS. 2 and 3, the rotary valve 14 includes a valve rotor 55 and a cylindrically shaped valve body 30 having an cylindrical interior chamber with an interior surface 31 defined by rotation of a line about the axis 32 of the valve 14. Four equally sized ports 33, 34, 35 and 36 are formed in and spaced around the circumference of the cylindrical interior surface 31 of the valve body 30. Port 33 is a feed port connected to input line 13, port 34 is a bed port connected to line 18 and bed 16, port 35 is the exit port connected to line 22 and port 36 is a bed port connected to bed 15 by line 17. Ports 34, 35 and 36 are equally spaced from each other and port 33 is spaced an equal but greater distance from port 34 and from port 36. More specifically, ports 33, 34, 35 and 36 are preferably rectangular and the circumferential widths of these ports are equal. There is about one circumferential port width between ports 34 and 35 and also between ports 35 and 36. There are about two circumferential port widths between port 33 and port 34 and also between port 33 and port 36. Thus the valve body 30 circumference is divided into 10 sectors. The maximum circumferential width of each of the four ports, 33, 34, 35, and 36, expressed in degrees is 36 degrees (360 degrees divided by 10). To allow for edge seals 69, 70 and 71, the four ports will be a little smaller, such as 25 to 35 degrees on the circumference.

Figure 5:
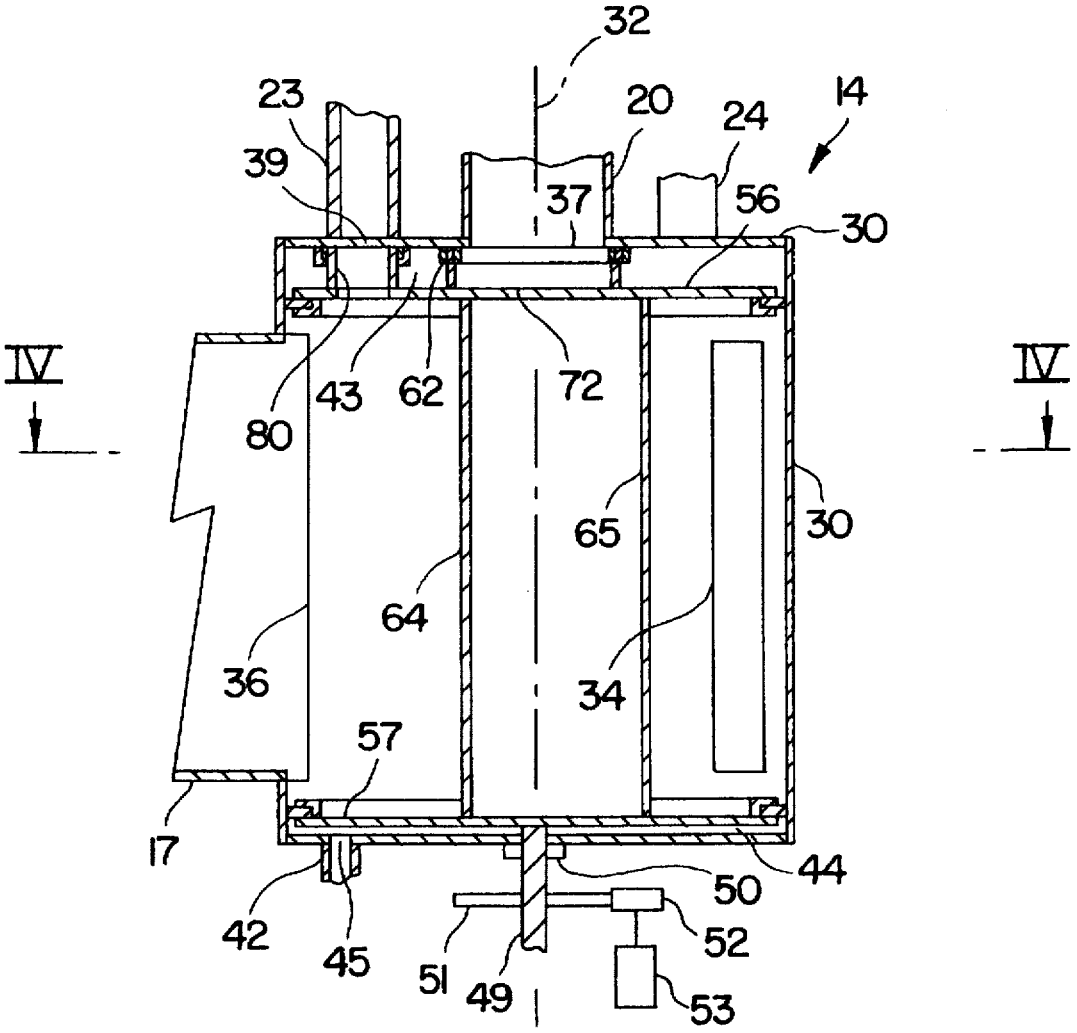
FIG. 5 is a horizontal section taken along the line V—V in FIG. 4.

At one end of the valve body 30 there is formed an axial bypass port 37 connected to a by-pass line 20 which in turn is connected to the combustion chamber 19. Also, at one end of the valve body 30 there are a pair of purge ports 39, 40, as shown in FIGS. 2 and 5, which are connected to branch purge lines 23, 24, respectively.

Figure 9:
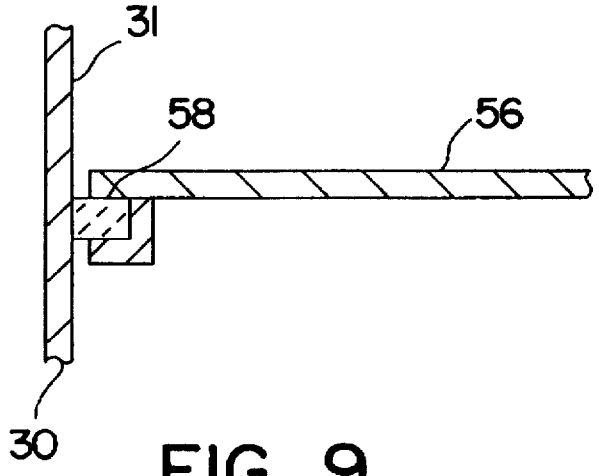
FIG. 9 is a vertical section of the seal between the valve housing and the valve rotor end disk.
Figure 10:
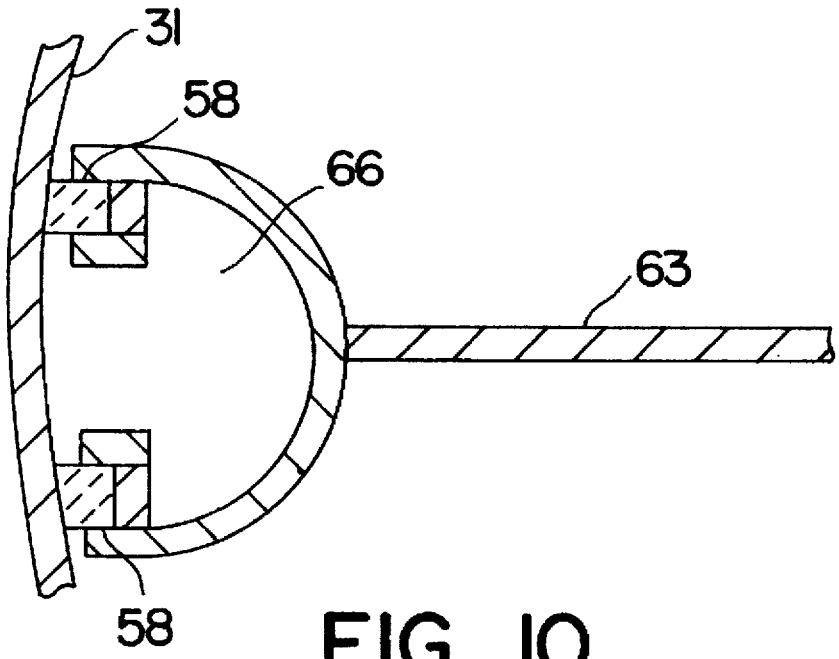
FIG. 10 is a horizontal section of the dual seal between the cylindrical valve housing and the valve rotor.

The cylindrical rotor 55 includes a pair of parallel end disks 56 and 57 which are spaced slightly from the end surfaces of the interior chamber of the valve body 30 to define upper and lower end cavities 43, 44. The diameter of the disks 56 and 57 is slightly less than the inside diameter of the valve body interior surface 31. As shown in FIG. 9, flexible packing 58 provides a nearly gas tight seal between the end cavities, 43 and 44, and the cavities within rotor 55. The cavity 43 is bounded by a top flat portion of the cylindrical interior surface 31 of the valve body 30 and the top of disk 56. The top disk 56 includes a cylindrically shaped by-pass port 62 which carries a cylindrical seal 73. The seal 73 is at least as large as the port 37 and provides a gas tight seal between the end of valve body 30 and the disk 56 on the upper end of the rotor 55. The seal 73 can be fastened to interior surface 31 and rub against disk 56 or the seal 73 may be fastened to the disk 56 and rub against interior surface 31. The cavity 44 at the lower end of the valve body 30 is bounded by the lower end of the valve body 30, the interior surface 31 and the bottom of the disk 57.

The end disks 56, 57 of the valve rotor 55 are interconnected by vertical walls forming a "wye" shaped structure comprised of a vertically extending flat plate 63 and a pair of vertically extending curved plates 64, 65. The three plates or walls 63, 64 and 65, which divide the valve rotor into two bed cavities 59, 61 and a bypass cavity 60, are secured to one another, as by welding, at a line spaced from the axis 32 of the valve rotor 55 and extending radially outward to present radially outer vertical end surfaces in confronting relation to the cylindrical interior surface 31. As shown in FIGS. 3, 4, 6, 7 and 10, double seals 69, 70 and 71 are provided at the radially outer edges of plates 63, 64 and 65. Packing material 58 in the double seals 69, 70, 71 rubs against the interior surface 31 to provide a relatively tight gas seal. The cavities 66 of the seals 69, 70, 71 are bounded by interior cylindrical surface 31 and by the two legs 67 and 68 of the channels forming the dual seals 69, 70 and 71. The upper and lower ends of the cavities 66 are in free flow communication with the end cavities 43 and 44 at the opposite ends of the valve rotor 55. Thus both cavities 43, 44 are purged by minor purge line 42. The cavities 43, 44 and 66 are maintained at a lower pressure than the exit line 22 by the blower 12 or by an auxiliary blower, not shown. Gas which normally leaks past the various seals is collected in cavities 43, 44 and 66 and returned to the blower 12 for reprocessing. Thus the purified exit gas is not contaminated by any normal valve leakage.

Plates 64 and 65 are curved at their radially inner ends so that the bypass cavity 60 is in flow communication with an annular opening 72 in the upper end of the valve rotor 55. The annular opening 72 is in constant free flow communication with the by-pass port 37 in the upper end of the valve body 55 by way of the valve rotor by-pass port 62.

Figure 4:
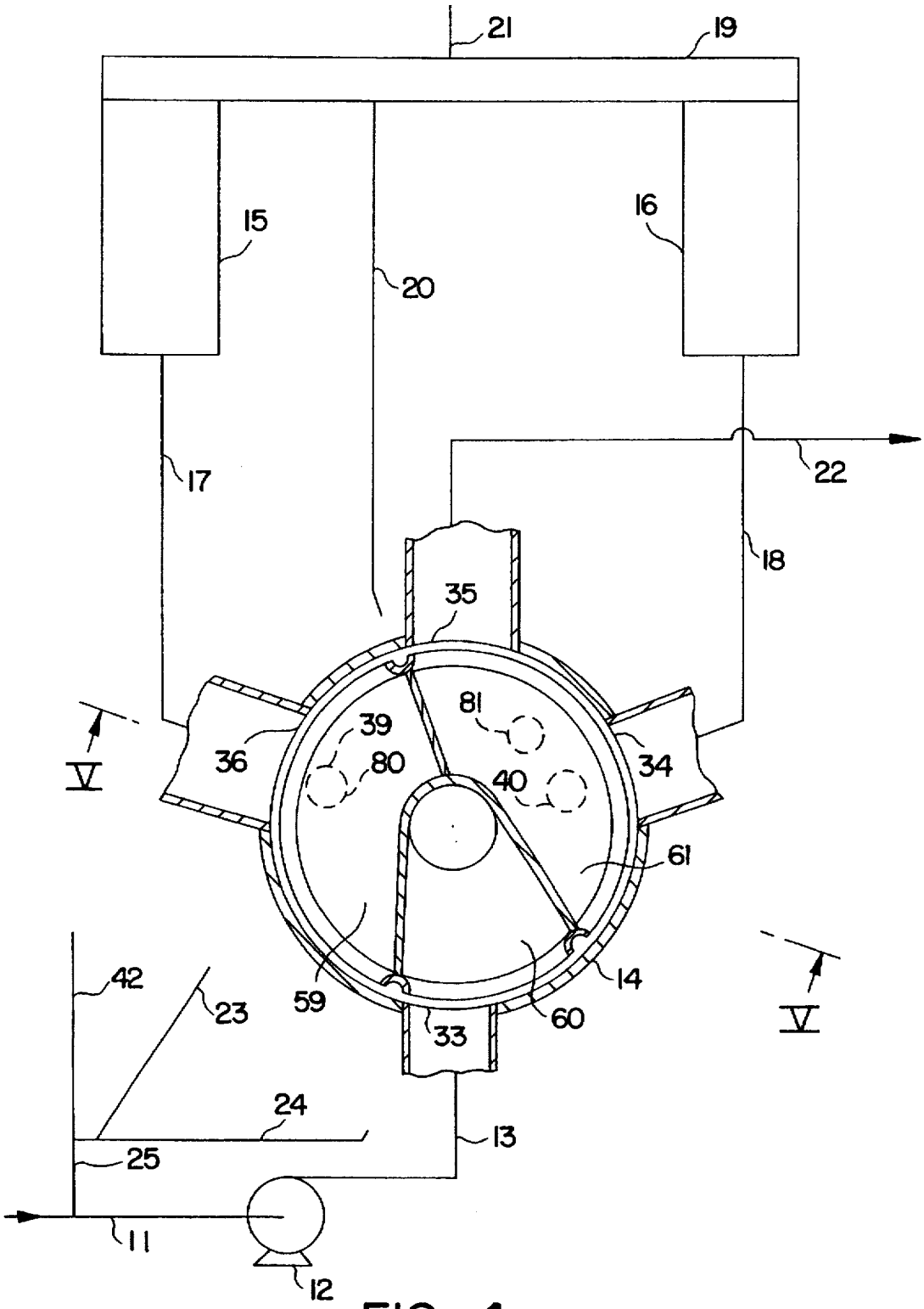
FIG. 4 is a section taken along the line IV—IV in FIG. 5 with the rotor positioned to show the first bed being purged.
Figure 5A:
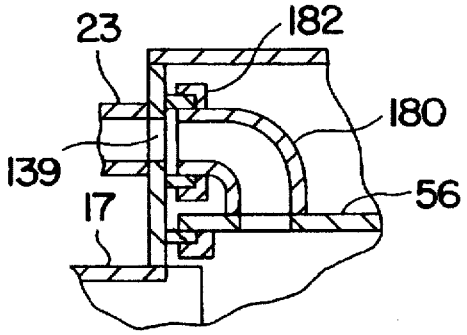
FIG. 5A is a section showing an alternative construction for the purge ports in the valve rotor and the valve body.
Figure 7:
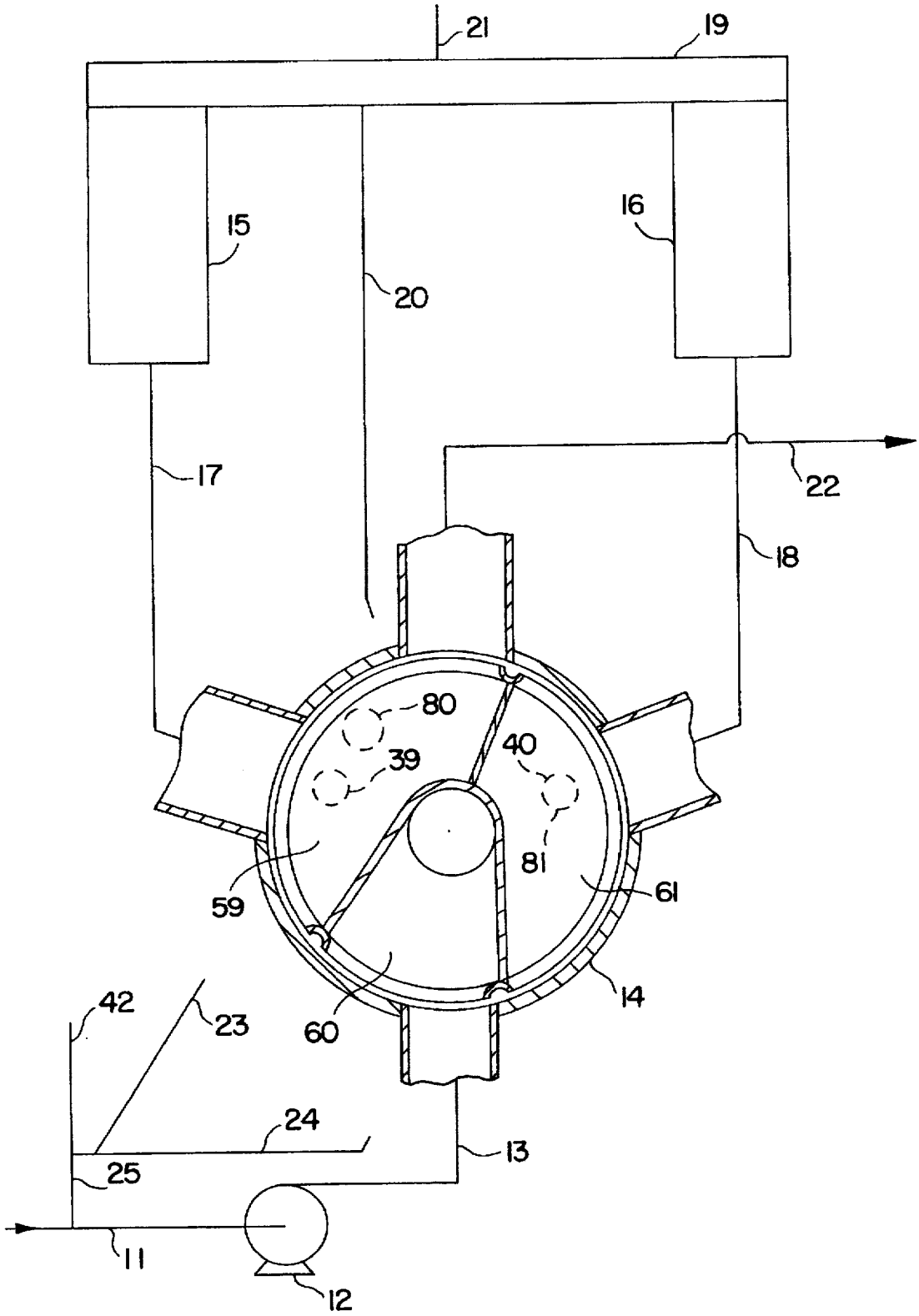
FIG. 7 is similar to FIG. 3 with the rotor positioned to show the second bed being purged.
Figure 8:
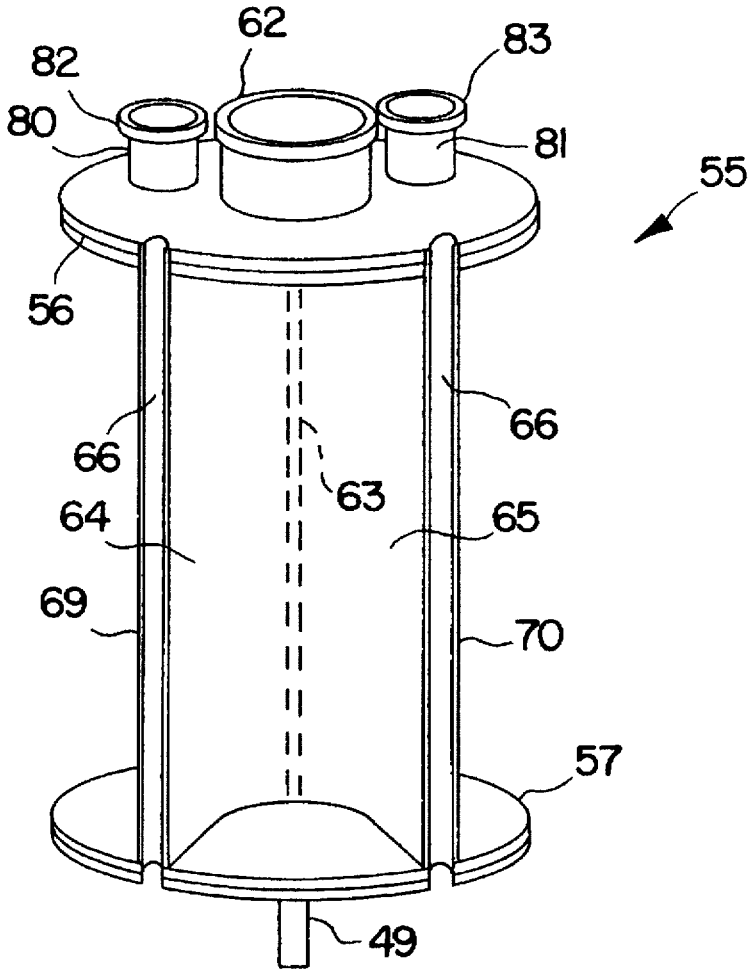
FIG. 8 is an isometric view of the rotor.

FIG. 8 is an isometric view of the valve rotor 55 showing the upper and lower disks 56, 57, and the curved plates 64, 65 with their double seals 69, 70, the cavities 66 of which interconnect the end cavities 43, 44. Also shown are the rotor shaft 49, the bypass port 62 with its sliding seal 73 and the purge ports 80, 81 with their sliding seals 82, 83. As shown in FIGS. 2 and 5, the seals 82, 83 sealingly engage the flat top surface of the interior chamber of the valve body 30 to block flow through the purge ports 80, 81 except when they register with valve body purge ports 39, 40, respectively. As illustrated in FIGS. 4 and 5, when the valve rotor 55 is rotated to its purge operating position for purging bed 15, the purge port 80 is in registration with the purge port 39 in the valve body 30. Likewise, when the valve rotor 55 is rotated to its purge operating position for purging bed 16, as shown in FIG. 7, the valve rotor purge port 81 registers with the valve body purge port 40. It will be noted that in the non-purging operating position of the valve rotor 55 illustrated in FIGS. 3 and 6, the purge ports 80, 81 do not register with either of the valve body purge ports 39, 40 and the purge ports 80, 81 are blocked. FIG. 5A shows an alternative construction for the purge ports wherein a valve rotor purge port 180 is a tubular elbow secured as by welding to the top plate 56 of the valve rotor 55 and an annular valve housing purge port 139 is formed in the cylindrical surface 31. An annular siding seal 182 is mounted on the radially outer end of the elbow shaped purge port 180 for sealing engagement with interior cylindrical surface 31 of the valve body 55.

Figure 11:
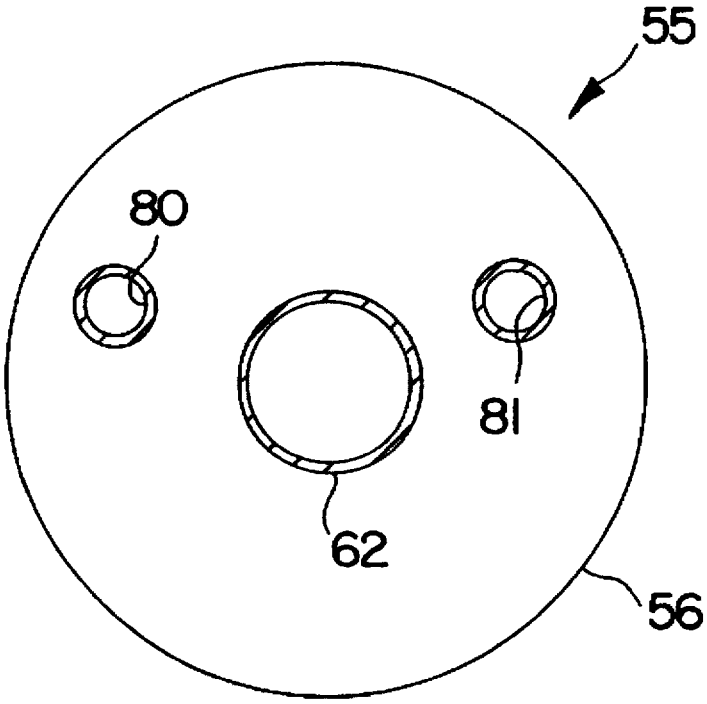
FIG. 11 is an end view of the rotary valve taken along line XI—XI in FIG. 2 showing the purge ports in the valve rotor and FIG. 12 is a flow diagram of a 2-bed regenerative fume incinerator in which the purge flows are controlled by 2-way valves.

FIG. 11 is a horizontal section showing the purge ports 80, 81 and the by-pass port 62 formed in the upper disk 56 of the valve rotor 55.

Figure 12:
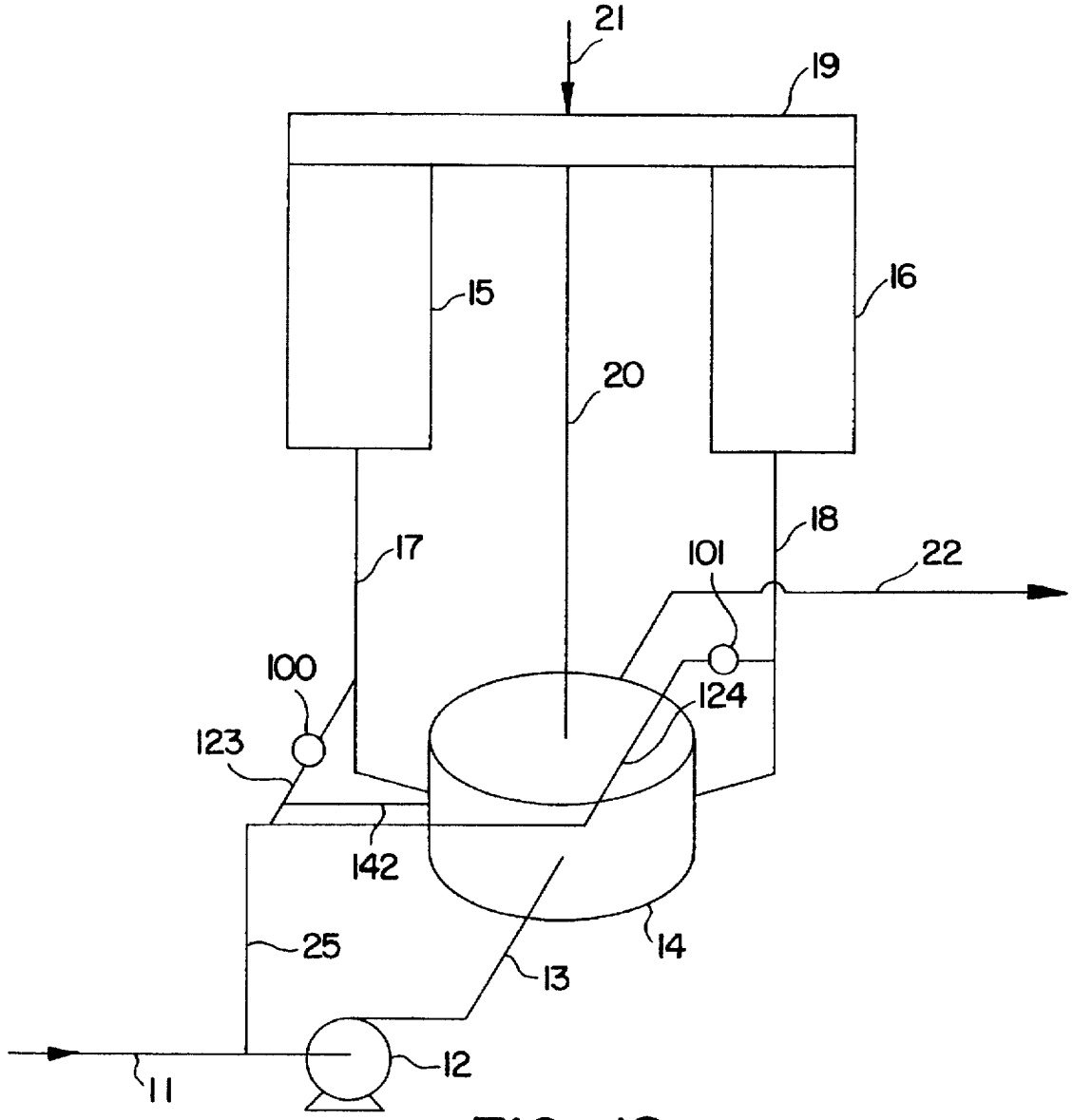

FIG. 12 is an embodiment of the invention in which the purge flow from the beds 15, 16 is routed to the feed line by branch purge lines 123, 124 connected to bed lines 17, 18 rather than the rotary valve 14. Power operated two-way valves 100, 101 are installed in the branch purge lines 123, 124, respectively, and are alternately adjusted between closed and open positions in synchronized manner with the positioning of the rotor of the valve 14.

OPERATION

The valve rotor 55 can be cyclically rotated to 4 positions (two non-purging operating positions and two purging operating positions) by rotation of the valve shaft 49 by a power operated driving mechanism, such as the illustrated in FIG. 2, in which an electric motor 53 drives the shaft 49 through gears 52, 51. An electronic control system, not shown, for the incinerator includes, a timer, not shown, operative to cyclically rotate the valve rotor between its flow control positions.

FIG. 3 shows the valve rotor 55 in its initial run or non-purging operating position which allows feed gas flow from the input line 13 through the bed cavity 59 of the rotor 55, to the bed conduit 17, to the bed 15 and to the combustion chamber 19 where the organic matter is oxidized to CO2 and H2O. Hot purified gas from the combustion chamber 19 flows through the bed 16 where it is cooled as the bed absorbs heat from the hot gas. The purified gas exits the bed 16 through line 18 to bed cavity 61 of the valve rotor 55, to exit line 22 for discharge as purified gas. By-pass cavity 60 is dead ended against the inside surface 31 of valve body 30 and has no flow. In FIG. 3, and also in FIGS. 4, 6, and 7, the purge ports 80, 81 in the rotor 55 and the purge ports 39, 41 in the valve body 30 would not normally appear; however, they are shown in broken lines to show their positions above the horizontal plane of these views. As will be noted upon reference to FIG. 3, the rotor purge ports 80, 81 do not register with the valve body purge ports 39, 40, and thus the rotor purge ports 80, 81 are closed by their seals engaging the flat top surface of the interior chamber of the valve body 30.

In the purging operating position of the valve rotor 55 shown in FIGS. 4 and 5, the valve rotor 55 is in its first purge position, in which the bed 15 is purged. Feed or input line 13 connects to the by-pass cavity 60, thereby connecting the input line 13 to the combustion chamber 19 by way of by-pass line 20. Purified gas from the combustion chamber 19 continues to flow through bed 16 for cooling the gas, then through line 18 to the bed cavity 61 and then to the exit line 22 for discharge as purified gas. The bed 15 is purged by purified gas from the combustion chamber 19 flowing through bed 15, through line 17 to the bed cavity 59, through the rotor purge port 80 in the end disk 56, which now is in alignment with the purge port 39 in the valve body 30, and then into the branch purge line 23 for discharge into the feed line 11 on the suction side of the blower 12. The valve rotor 55 is in this first purge position for less than 30% of the time that the valve rotor 55 is in its initial run position. The initial run position is maintained for about 30 to 500 seconds.

Figure 6:
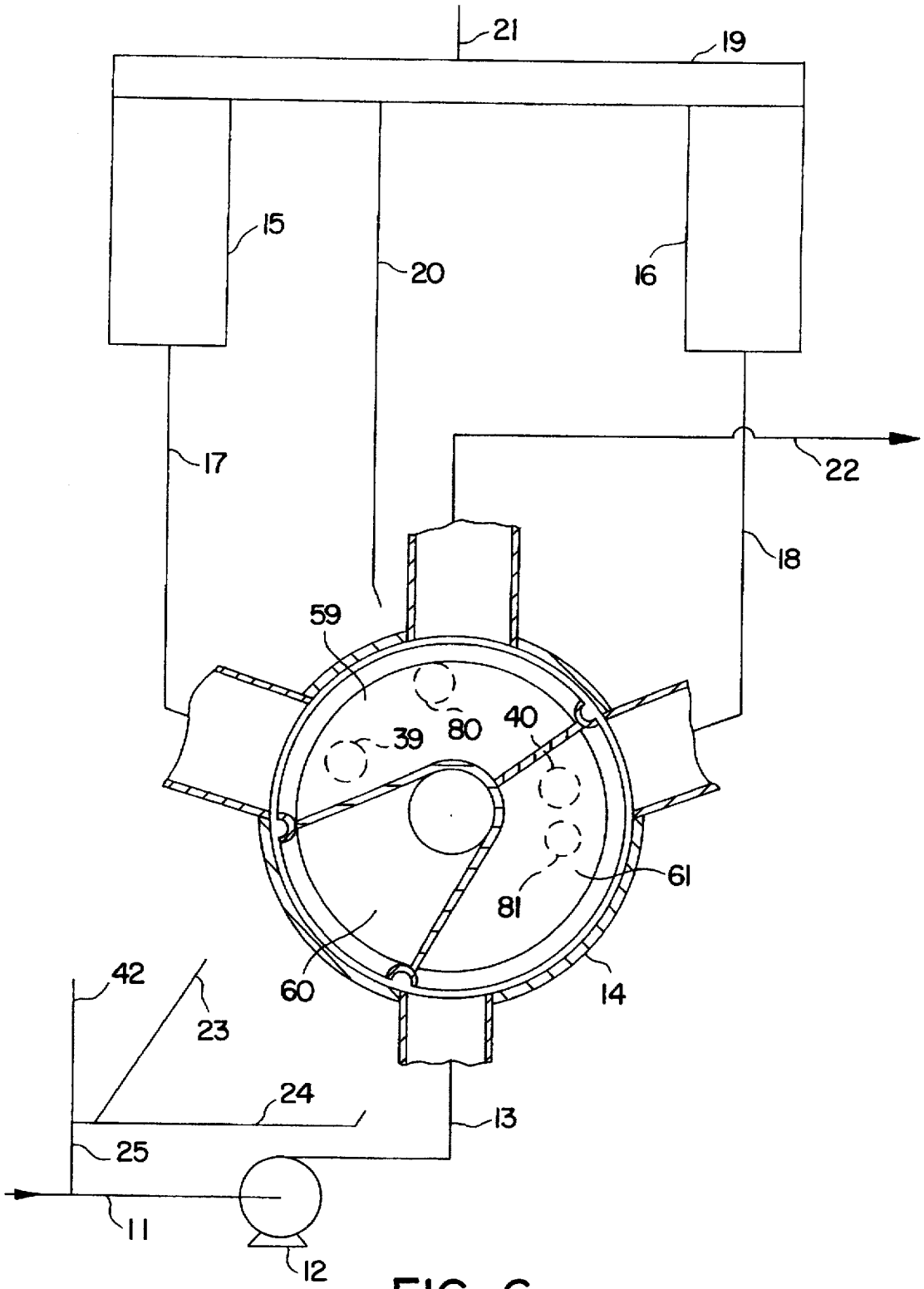
FIG. 6 is a view similar to FIG. 3 with the rotor positioned to show the feed connected to the second bed.

FIG. 6 shows the valve rotor 55 in its second non-purging operating position, which allows flow from the input line 13 through the rotor bed cavity 61, to bed line 18, then to the bed 16 and to the combustion chamber 19. Purified gas from the combustion chamber 19 flows through the bed 15 for cooling the gas, through the bed line 17 to the rotor bed cavity 59, then to the exit line 22 for discharge as purified gas. The by-pass cavity 60 is dead ended against the interior cylindrical surface 31 of the valve body 30 and has no flow. The rotor purge ports 80, 81 are blocked by the flat interior surface of the valve body 30. The second non-purging operating position of the valve rotor 55 is maintained about as long as the first non-purging operating position.

FIG. 7 shows the rotor 55 in its second purging operating position in which the bed 16 is purged. In this position, the feed line 13 connects to the by-pass cavity 60, which in turn is connected to the combustion chamber 19 by way of the by-pass line 20. Purified gas from the combustion chamber 19 continues to flow through the bed 15 for cooling the gas, through the bed line 17 to the rotor bed cavity 59, to the exit line 22 for discharge as purified gas. The bed 16 is purged by purified gas from the combustion chamber 19 flowing through the bed 16, through the bed line 18 to the rotor bed cavity 61, through the rotor purge port 81, which is now in registration with the purge port 40 in the valve body 30, and into the branch purge conduit 24 for discharge into the feed line 11 on the suction side of the blower 12. The valve rotor 55 is in this second purging operating position for less than 30% of the time interval that valve rotor 55 is in a non-purging operating position.

The drive shaft 49 in FIG. 2 is shown on the opposite end of valve 14 from the by-pass line 20. As an alternate construction, it may be desirable to provide an extension similar to line 20 which firmly attaches to the valve rotor end plate 56 and extends out of the valve body 30 through a suitable bearing. Gears and a motor, similar to gears 51, 52 and motor 53, may be attached to the extension to index the rotor.

A steady flow, with essentially no pressure surges, can be obtained by proper design. When the rotor is in either one of its purging operating positions, the main flow passes through only one bed and the pressure drop is less than when the rotor is in its non-purging operating positions. This decreased pressure drop can be balanced by the amount of recycle flow through the blower and the correspondingly lower pressure rise. A trimming damper, not shown, can be installed in purge line 25 and adjusted to balance the pressures at various main flows.

What is claimed is:

1. A rotary valve for a regenerative fume incinerator having two beds with corresponding ends connected to a combustion chamber, said rotary valve comprising;

a generally cylindrical shape, valve body having upper and lower ends and including an interior chamber defined by rotation of a line about a vertical axis, said interior chamber including a generally cylindrical surface, a by-pass port at an end of said valve body, a feed port having a circumferential width between 25 and 36 degrees, an exit port of the same size as said feed port and positioned diametrically opposite to said feed port, a first bed port of the same size as said feed port and located at one side of said rotor between said feed port and said exit port and spaced at least two port widths from said feed port, a second bed port of the same size as the feed port and located at the other side of said rotor between said feed port and said exit port and spaced at least two port widths from said feed port, said feed, exit, first bed and second bed ports being generally in a plane perpendicular to said axis, an axial by-pass port in said one end of said valve body and a first purge port at an end of said valve body, a second purge port at an end of said valve body, a valve rotor rotatably mounted within said valve body including a first rotor end disk located near one end of said interior chamber with the radially outer edge of said disk in confronting relation to said cylindrical surface of said valve body and with a bypass port in flow communication with said axial bypass port in said valve body, a second rotor end disk located adjacent to the end of said interior chamber opposite said one end of said interior chamber with the edge of said disk in confronting relation to said cylindrical surface of said interior chamber, vertical walls extending between and interconnecting said first and second end disks and presenting three vertical edges in confronting relation to said cylindrical surface of said interior chamber to form first and second radially open bed cavities and a radially open by-pass cavity, said first and second bed cavities each having an outer circumferential width of slightly less than 144 degrees and said bypass cavity having an outer circumferential width of slightly less than 72 degrees, a first valve rotor purge port in said valve rotor in free flow communication with said first bed cavity and registrable with said first valve body purge port, a second valve rotor purge port in said valve rotor in free flow communication with said second bed cavity and registrable with said second valve body purge cavity, said valve rotor being rotatable to a first operating position in which said first bed cavity places said feed port in flow communication with said first bed port and said second bed cavity places said second bed port in flow communication with said exit port, said valve rotor being rotatable to a second operating position in which said feed port is in flow communication only with said by-pass cavity, said second bed cavity places said second bed port in flow communication with said exit port, said first bed cavity registers with said first bed port and said first valve rotor purge port registers with said first valve body purge port, said valve rotor being rotatable to a third operating position in which said first bed cavity places said first bed port in flow communication with said exit port and said second bed cavity places said feed port in flow communication with said second bed port, said valve rotor being rotatable to a fourth operating position in which said first bed cavity places said first bed port in flow communication with said exit port, said feed port registers only with said by-pass cavity, said second bed cavity registers with said second bed port and said second valve rotor purge port registers with said second valve body purge port.

2. The rotary valve of claim 1 and further comprising control means cyclically moving said valve rotor in a predetermined rotative direction from said first operating position to said second, third and fourth operation positions and then in a reverse direction back to said first operating position, said control means maintaining said valve rotor in each of said first and third operating positions for a first time interval of 30 to 500 seconds and maintaining said valve rotor in each of said second and fourth operation positions for a second time interval of not more than 30 percent of said first time interval.

3. The rotary valve of claim 1 wherein said feed, exit, first bed and second bed ports are rectangular.

4. The rotary valve of claim 1 wherein the circumferential width of said feed port is between 25 degrees and 35 degrees.

5. The valve rotor of claim 1 and further comprising vertically extending channels on said vertical edges of said walls of said rotor, said channels having radially outward extending legs terminating in confronting relation to said cylindrical surface of said interior chamber, said channels forming a purgable edge cavity and establishing flow communication between the upper and lower ends of said interior chamber.

6. The rotary valve of claim 5 and further comprising means venting said upper and lower ends of said interior chamber at a pressure lower than the pressure of the gas in said exit port.

7. The rotary valve of claim 5 and further comprising means venting said upper and lower ends of said interior chamber by pressurizing said upper and lower ends of said interior chamber with a pure gas at a pressure greater than the pressure of the gas in said feed port.

8. The rotary valve of claim 1 wherein said first and second valve rotor purge ports open radially outward and wherein said first and second valve body purge ports are formed in said cylindrical surface of said valve body.

9. The rotary valve of claim 1 wherein said interior chamber includes flat end surfaces in confronting relation to axially opposite ends of said valve rotor and wherein at least one of said valve body purge ports is formed in a flat end surface.

10. The rotary valve of claim 9 wherein said first and second valve body purge ports are formed in one of said flat end surfaces.

11. The rotary valve of claim 9 wherein said first and second valve body purge ports are formed in said flat surfaces, respectively.

12. A rotary valve, for a regenerative fume incinerator having two beds with corresponding ends connected to a combustion chamber, said rotary valve comprising;

a generally cylindrical shaped valve body having upper and lower ends and including an interior chamber defined by rotation of a line about a vertical axis, said interior chamber including a generally cylindrical surface and upper and lower ends, a feed port in said cylindrical surface having a circumferential width between 25 and 36 degrees, an exit port in said cylindrical surface of the same circumferential width as said feed port and positioned diametrically opposite to said feed port, a first bed port in said cylindrical surface of the same circumferential width as said feed port and located at one side of said valve body between said feed port and said exit port and spaced circumferentially at least two port widths from said feed port, a second bed port in said cylindrical surface of the same circumferential width as the feed port and located at the other side of said valve body between said feed port and said exit port and spaced at least two port widths from said feed port, said feed port, said exit port, said first bed port and said second bed port being generally in a plane perpendicular to said axis and an axial by-pass port in one of said ends of said valve body, a valve rotor rotatably mounted within said valve body including a first rotor end disk coaxial with and located near one end of said interior chamber with the radially outer edge of said disk in confronting relation to said cylindrical surface of said valve body and with a bypass port in flow communication with said axial bypass port in said valve body, a second rotor end disk coaxial with and located adjacent to the end of said interior chamber opposite said one end of said interior chamber with the edge of said disk in confronting relation to said cylindrical surface of said interior chamber, vertical walls extending between and interconnecting said first and second end disks and presenting three vertical edges in confronting relation to said cylindrical surface of said interior chamber to form first and second radially open bed cavities and a radially open by-pass cavity, said first and second bed cavities each having an outer circumferential width of slightly less than 144 degrees and said bypass cavity having an outer circumferential width of slightly less than 72 degrees, said valve rotor being rotatable to a first operating position in which said first bed cavity places said feed port in flow communication with said first bed port and said second bed cavity places said second bed port in flow communication with said exit port, said valve rotor being rotatable to a second operating position in which said feed port is in flow communication only with said by-pass cavity, said second bed cavity places said second bed port in flow communication with said exit port and said first bed cavity registers with said first bed port, said valve rotor being rotatable to a third operating position in which said first bed cavity places said first bed port in flow communication with said exit port and said second bed cavity places said feed port in flow communication with said second bed port, said valve rotor being rotatable to a fourth operating position in which said first bed cavity places said first bed port in flow communication with said exit port, said feed port registers only with said by-pass cavity and said second bed cavity registers with said second bed port.

13. The rotary valve of claim 12 and further comprising vertically extending channels on said vertical edges of said walls or said valve rotor, said channels having radially outward extending legs in confronting relation to said cylindrical surface of said interior chamber, said channels forming a purgable edge cavity and establishing flow communication between said upper and lower ends of said interior chamber.

14. A regenerative fume incinerator for purifying impure gas comprising:

first and second beds of refractory material, each having a top end and a bottom end, a combustion chamber connected to said top ends of said beds, a blower having an input side and an delivery side, an impure gas feed line connected to said input side of said blower, a rotary valve including a generally cylindrical valve body having upper and lower ends, an interior surface defined by rotation of a line about an axis, first and second bed ports spaced circumferentially from one another about said interior surface, a feed port at one side of said valve body disposed between and spaced circumferentially from said bed ports, an exit port at the diametrically opposite side of said valve body from said feed port and disposed between and in circumferentially spaced relation to said bed ports, a by-pass port in said valve body in coaxial relation to said axis and first and second purge ports in one of said upper and lower ends of said valve body, said bed ports, said feed port and said exit port opening radially inward in a horizontal plane perpendicular to said axis and having substantially equal circumferential port widths of less than 36 degrees, said feed port being circumferentially spaced from each of said bed ports a distance slightly greater than twice said port width and said exit port being circumferentially spaced from each of said bed ports a distance slightly greater than said port width, an input line connecting said delivery side of said blower to said feed port, an exit line connected to said exit port, a first bed line connecting said first bed port to said bottom end of said first bed, a second bed line connecting said second bed port to said bottom end of said second bed, a by-pass line connecting said by-pass port in said valve body to said combustion chamber, means connecting said purge ports in said valve body to said feed line on the input side of said blower, a valve rotor rotatably mounted in said valve body for rotation about said axis including a pair of vertically spaced upper and lower parallel end disks, walls extending vertically between and secured to said disks to define first and second radially outward open bed cavities and a radially outward open by-pass cavity, a by-pass port in one of said disks in free flow communication with said by-pass cavity and in constant registration with said by-pass port in said valve body, a first bed cavity purge port registrable with said first valve body purge port and a second bed cavity purge port registrable with said second valve body purge port, said valve rotor being rotatable to a first operating position in which said first bed cavity connects said feed port in flow communication with said first bed port, said second bed cavity connects said second bed port in flow communication with said exit port, said by-pass cavity is blocked and said bed cavity purge ports are blocked, said valve rotor being rotatable to a second operating position in which said feed port is connected to said by-pass cavity thereby delivering impure gas to said combustion chamber by way of said by-pass line, said second bed cavity connects said second bed port in flow communication with said exit port, said first bed cavity registers with said first bed port and said first purge port in said rotor registers with said first purge port in said valve body, said valve rotor being rotatable to a third operating position in which said first bed cavity connects said first bed port in flow communication with said exit port, said second bed cavity connects said feed port in flow communication with said second bed port, said by-pass cavity is blocked and said bed cavity purge ports are blocked, said valve rotor being rotatable to a fourth operating position in which said first bed cavity connects said first bed port in flow communication with said exit port, said by-pass cavity registers with said feed port thereby delivering impure gas to said by-pass line and said second bed cavity registers with said second bed port and said purge port in said rotor registers with said second purge port in said valve body.

15. A regenerative fume incinerator for purifying impure gas comprising:

first and second beds of refractory material, each having a top end and a bottom end, a combustion chamber connected to said top ends of said beds, a blower having an input side and an delivery side, an impure gas feed line connected to said input side of said blower, a rotary valve including a generally cylindrical valve body having upper and lower ends, an interior surface defined by rotation of a line about an axis, first and second bed ports spaced circumferentially from one another about said interior surface, a feed port at one side of said valve body disposed between and spaced circumferentially from said bed ports, an exit port at the diametrically opposite side of said valve body from said feed port and disposed between and in circumferentially spaced relation to said bed ports, a by-pass port in said valve body in coaxial relation to said axis and said bed ports, said feed port and said exit port opening radially inward in a horizontal plane perpendicular to said axis and having substantially equal circumferential port widths of less than 36 degrees, said feed port being circumferentially spaced from each of said bed ports a distance slightly greater than twice said port width and said exit port being circumferentially spaced from each of said bed ports a distance slightly greater than said port width, an input line connecting said delivery side of said blower to said feed port, an exit line connected to said exit port, a first bed line connecting said first bed port to said bottom end of said first bed, a second bed line connecting said second bed port to said bottom end of said second bed, a by-pass line connecting said by-pass port in said valve body to said combustion chamber, a first purge line connecting said lower end of said first bed to said feed line on the input side of said blower, a second purge line connecting said lower end of said second bed to said feed line on the input side of said blower, a power operated two-way valve in each of said purge lines, each of said valves having open and closed positions, a valve rotor rotatably mounted in said valve body for rotation about said axis including a pair of vertically spaced upper and lower parallel end disks, walls extending vertically between and secured to said disks to define first and second radially outward open bed cavities and a radially outward open by-pass cavity and a by-pass port in one of said disks in free flow communication with said by-pass cavity and in constant registration with said by-pass port in said valve body, control means for controlling operation of said two-way valves in coordination with sequential rotation of said valve rotor to a first operating position in which said first bed cavity connects said feed port in flow communication with said first bed port, said second bed cavity connects said second bed port in flow communication with said exit port, said by-pass cavity is blocked and said two-way valves are in their closed positions, to a second operating position in which said feed port is connected to said by-pass cavity thereby delivering impure gas to said combustion chamber by way of said by-pass line, said second bed cavity connects said second bed port in flow communication with said exit port, said first bed cavity registers with said first bed port, said two-way valve in said first purge line is open and said two-way valve in said second purge line is closed, to a third operating position in which said first bed cavity connects said first bed port in flow communication with said exit port, said second bed cavity connects said feed port in flow communication with said second bed port, said by-pass cavity is blocked and said two-way valves are closed and to a fourth operating position in which said first bed cavity connects said first bed port in flow communication with said exit port, said by-pass cavity registers with said feed port thereby delivering impure gas to said by-pass line and said second bed cavity registers with said second bed port, said two-way valve in said second purge line is open and said two-way valve in said first purge line is closed.

* * * * *